US010653907B1

(12) United States Patent
Yoder

(10) Patent No.: US 10,653,907 B1
(45) Date of Patent: May 19, 2020

(54) FIRE SPRINKLER HEAD EMERGENCY DRAIN APPARATUS

(71) Applicant: Eli J. Yoder, Sarasota, FL (US)

(72) Inventor: Eli J. Yoder, Sarasota, FL (US)

( * ) Notice: Subject to any disclaimer, the term of this patent is extended or adjusted under 35 U.S.C. 154(b) by 0 days.

(21) Appl. No.: 16/210,600

(22) Filed: Dec. 5, 2018

(51) Int. Cl.

| | |
|---|---|
| ***A62C 35/00*** | (2006.01) |
| ***A62C 35/68*** | (2006.01) |
| ***E03B 7/08*** | (2006.01) |
| ***A62C 99/00*** | (2010.01) |

(52) U.S. Cl.
CPC ..... *A62C 35/68* (2013.01); *A62C 99/009* (2013.01); *E03B 7/08* (2013.01)

(58) Field of Classification Search
CPC ..... A62C 35/68; Y10T 137/5762
See application file for complete search history.

(56) References Cited

U.S. PATENT DOCUMENTS

| | | | | |
|---|---|---|---|---|
| 4,245,666 | A | 1/1981 | Norris | |
| 4,784,184 | A | 11/1988 | Gates | |
| 4,883,102 | A | 11/1989 | Gabrielyan et al. | |
| 5,052,149 | A | 10/1991 | Johnson | |
| 5,172,718 | A | 12/1992 | Thornburgh | |
| 5,344,193 | A | 9/1994 | Rio | |
| 5,725,009 | A * | 3/1998 | Mallow, Sr. | F16L 55/18 137/15.09 |
| 5,752,540 | A | 5/1998 | Hansel, Sr. | |
| 6,227,232 | B1 | 5/2001 | Williams, Sr. | |
| 6,845,784 | B2 | 1/2005 | Pascznk | |
| 10,413,766 | B2 * | 9/2019 | Mete | A62C 35/60 |
| 2004/0123904 | A1 * | 7/2004 | Pascznk | A62C 99/00 137/312 |
| 2013/0334809 | A1 * | 12/2013 | Cole, Jr. | B05B 15/00 285/13 |

* cited by examiner

*Primary Examiner* — Reinaldo Sanchez-Medina
(74) *Attorney, Agent, or Firm* — Dowell & Dowell, P.C.

(57) ABSTRACT

A fire sprinkler emergency drain apparatus for conveying liquid from an open or leaking sprinkler head or leaking portion of a fire extinguishing system that includes a shallow mouth collection ring and drain line assembly having a collection ring of a size to surround a fire sprinkler head or a recessed opening in which a fire sprinkler head is positioned and a flexible drain line connected to the collection ring to convey liquid from the sprinkler head to a drain area, the drain line being mounted in a rolled configuration wherein the drain line is flattened in cross sectional configuration adjacent the collection ring and the shallow mouth collection ring and drain line assembly being supported by a handle adapted to be attached to a pole for use in elevating the shallow mouth collection ring and drain line assembly relative to a sprinkler head.

16 Claims, 6 Drawing Sheets

FIRE SPRINKLER HEAD EMERGENCY DRAIN APPARATUS

BACKGROUND OF THE INVENTION

Field of the Invention

This application is directed to the field of fire safety devices for use in buildings having fire sprinkler systems that include ceiling and/or wall mounted sprinkler heads that are designed and constructed to be automatically operated upon the detection of heat. More particularly, the application is directed to devices for preventing damage to structures and possessions caused by accidental activation of one or more sprinkler heads not caused by a response to fire or heat associated with a fire. The safety devices of the invention are designed and constructed to be manually deployed to cover an opened sprinkler head to collect liquid being discharged from a malfunctioning or accidentally operated sprinkler head and direct the discharge to a drain or to an exterior of a structure until the sprinkler system can be shut down to prevent further liquid discharge from the opened sprinkler head.

Brief Description of the Prior Art

For safely purposes to prevent injury or death from fires, pressurized ceiling or wall mounted sprinkler systems are required by many jurisdictions in commercial buildings including hospitals, labs, airports, libraries, art galleries, banks, hotels, as well as in some residential structures such as apartments. Sprinkler systems are also being used more frequently in single family homes. Such systems include, within each area of a structure, one or a plurality of sprinkler heads through which water is discharged when normally closed discharge valves are opened in response to the detection of heat above a predetermined temperature. Each sprinkler head includes a thermosensitive element, such as a frangible glass ampule, that is filled with a heat sensitive liquid. When temperature in the area of the ampule reaches a predetermined level, the heat sensitive liquid expands to rupture the ampule. The glass ampule normally blocks the discharge valve of the sprinkler head, however, when the ampule is shattered by the temperature sensitive liquid expanding, the discharge valve is automatically opened to discharge water into the affected area to combat a fire.

Unfortunately, glass ampules can be accidentally broken causing water to be discharged into an area or room where there is no fire. To limit water damage to areas that are not threatened by fire, action must be taken as quickly as possible by channeling the discharge of water to a drain or to an exterior area of a structure until water to the open sprinkler head can be shut off. There have been a number of devices developed for temporarily and manually collecting and channeling water from an accidentally activated sprinkler head to an appropriate water collection device or drain.

U.S. Pat. No. 6,845,784 to Pascznk discloses a fire sprinkler water catching apparatus for channeling water from an open sprinkler head to a drain to prevent water damage in the area of an accidentally opened sprinkler head. The patented apparatus is portable and incudes a funnel having an upper cup shaped portion having a bottom with a drain opening to which a drain hose must be connected for use. The drain hose is of sufficient length to convey water from the funnel to a drain such as a sink or the like. A flexible membrane extends over a top of the funnel and includes slits to allow the funnel to be forced over the accidentally opened sprinkler head. The funnel is mounted to an upper end portion of an extendable support pole so that the pole may be adjustably extended from a floor to and covering a sprinkler head during use. Once the funnel is mounted over a sprinkler head to channel water to the drain hose, the pole, when appropriately extended, will retain the funnel in place without further support by an individual. When not in use, the pole is adjusted to shorten the length for storage and the drain hose coiled for storage.

U.S. Pat. No. 6,227,232 to Williams, Sr. discloses another type of portable and manually manipulated device for channeling water from an accidently opened fire sprinkler head having a funnel portion of a sized to fit over the sprinkler head to catch water being discharged from the open sprinkler head. The funnel portion is connected to a flexible and non-collapsible tube that is pivotally mounted by a yoke member to an elongated pole that is manually manipulated during use. The tube is of sufficient length to extend to a drain. When not in use, the tube is folded in a serpentine configuration and stored within a carrying case.

U.S. Pat. No. 5,752,540 to Hansel, Sr. teaches a drain structure for draining water from an open fire sprinkler head which includes a tubular housing for enclosing the opened sprinkler head and which is designed to be pressure resistant to prevent further flow from the sprinkler head. The housing includes a hose bib to which a drain hose may be connected to thereby drain water from the housing to an appropriate water drain such as a sink.

U.S. Pat. No. 5,344,193 to Rio discloses a portable and manually operable water collection and conveying apparatus having a water collection chamber mounted at one end of a telescopically adjustable pole. Various conduit or pipe sections are used to connect the collection chamber to an end cap that is of a size to be placed over an open fire sprinkler head. The pipe sections allow the end cap to be oriented either in line with the collection camber or perpendicular to the collection chamber. In this manner, the end cap is aligned with the collection chamber when being placed over a ceiling mounted sprinkler head or angled relative the collection chamber to be engaged over a wall mounted sprinkler head. A hose is connected to the collection chamber to channel water to a drain. The pole is extendable so that one end thereof engages a floor when the end cap is placed over an open sprinkler head. When not in use, the hose is folded in parallel sections and a strap is used to secure the hose sections to the pole.

Other prior art US Patents that are of general interest to the field of the present invention include U.S. Pat. No. 5,725,009 to Mallow et al, U.S. Pat. No. 4,245,666 to Norris, U.S. Pat. No. 5,172,718 to Thornburgh, U.S. Pat. No. 5,052,149 to Johnson, U.S. Pat. No. 4,883,102 to Gabrielyan et al and U.S. Pat. No. 4,784,184 to Gates.

SUMMARY OF THE INVENTION

When considering the prior art, although manually operable and portable devices are generally taught for conveying water being discharged from an accidentally opened overhead or side wall sprinkler head, the devices are bulky making them difficult to store and use, especially by young or elderly people. In addition, the drain hoses of the prior art are either structured like conventional rubber lawn and garden hoses or flexible and collapsible fabric type fire hoses that must be attached to a collection device, such as a funnel, before use. It would be beneficial to have a lightweight manually operable and portable drain hose assembly that can be easily and compactly stowed, such as in a drawer or closest, when not in use, but easily placed into use with a drain line or hose that is compactly rolled for storage and yet readily deployable for use and which drain line is also connected to a water collection device even when stored. In addition, the present invention has a head that swivels automatically to adjust to any angle of wall or ceiling. Also, the prior art does not consider the possibility that a fire could actually start in an area where water from an accidentally opened sprinkler head is being channeled to a drain but is needed to control or extinguish the fire. In this respect, the fire sprinkler emergency drain device of the present invention overcomes problems not addressed by the prior art. Further, some of the prior art structures for capturing and channeling a flow of water from an open sprinkler head to a drain hose may not be of sufficient size to capture all flow from the sprinkler head, such as when a sprinkler head extends too far outwardly relative to a ceiling or wall surface.

The present invention includes a compact shallow mouth water collection ring and drain line assembly that is used to channel water from a sprinkler head of a fire extinguishing system that has been accidentally opened to an appropriate drain or the like to prevent water damage to the surrounding structures. The drain line is formed so as to be capable of being wound, when in a flattened configuration, to form a compact roll of drain line that is attached to receive water from the shallow mouth collection ring. The shallow mouth collection ring and drain line assembly is mounted to a carrying handle with the assembly and handle being so compact and light weight that it may be easily carried in one hand. The shallow mouth collection ring and drain line assembly, with a fifty foot or longer drain line, mounted to the handle can be stored in a 4 inch by 5 inch space. The shallow mouth collection ring is preferably formed of plastic and includes an upper annular open circular mouth or opening that is surrounded by a somewhat flexible annular tapered lip that is friction fitted to an upper portion of the shallow mouth collection ring so as to frictionally retain an inner end of the drain line there between. The lip has an upper annular flat surface that may be somewhat pliable or flexible to ensure a close fit or engagement of the shallow mouth collection ring and drain line assembly with a ceiling or wall surface. In this respect, the lip allows the shallow mouth collection ring to be used with newer recessed and flush mounted sprinkler heads as well as outwardly protruding sprinkler heads. The diameter of the outwardly flared lip is such to permit the shallow mouth collection ring to cover and seal over and around substantially any fire sprinkler head as a sprinkler head may extend through the shallow mouth collection ring and directly into the drain line during use of the invention. The shallow mouth collection ring and drain lip can be 4.0 inches or greater in diameter and the drain line is approximately 4 inches wide when flat and wound in a roll which is attached to the shallow mouth collection ring and lip.

The drain line is preferably formed of a polypropylene type of material into a tubular structure that can be wound in a flat configuration to form the wound roll of drain line that will expand when deployed. The diameter and length of the drain line may be varied as required. The plastic material must be sufficiently strong to convey pressurized water from an open sprinkler head without rupturing. Also, the plastic, in one embodiment, of both the shallow mouth collection ring and drain line assembly should be capable of quickly melting when exposed to heat and flames such that, should a fire break out near the small mouth collection ring and drain line assembly during use, the assembly will melt and thus no longer contain and convey water from an opened sprinkler head so the water will be distributed to the area of the fire from the sprinkler head.

The handle is adapted to be mounted to an elongated pole for elevating the shallow mouth collection ring and drain line assembly hose relative to a sprinkler head for use. The pole may be of convention structure and may be adjustable having a telescopically extendable and collapsible hollow sections that can be locked in selectively extended positions with respect to one another so as to be compactly situated with respect to one another for storage and readily extended to a predetermined length or height for use. For conventional home use, the poles may be extendable from three feet for storage to eight to twelve feet when in use. For commercial use and in homes having ceiling heights greater than twelve feet, the poles may extend from four or five feet when assembled for storage to twenty or more feet for use. The sections of the pole are locked to one another when in use by conventional lever locks mounted to the exterior of the pole sections or by way of interior annular twist locks mounted within the pole sections.

As opposed to mounting the small mouth collection ring and drain line assembly to a conventional adjustable pole, a modified pole could be used to allow for angular adjustment of the shallow mouth collection ring and drain line assembly during use. The modified pole may include two or more telescoping sections the may slide relative to one another and being locked in adjusted position by conventional pivot locks or twist locks. The shallow mouth collection ring and drain line assembly carried by the handle are secured to an angularly adjustable shaft having a first component that is securable to an outermost pole section of the telescoping sections and a second component that is secured to the handle that is angularly adjustable relative to the first component. An adjustable ratchet mechanism connects the first and second components. The ratchet mechanism includes a first ratchet plate connected to or integral with an outer end of the first component and a second ratchet plate connected to or integral with the second component. The first and second ratchet plates have opposing teeth that can be interlocked with one another by a manually adjustable knob that is adjustably mounted to the first and second ratchet plates to allow the plates to be rotated relative to one another in an unlocked position and locked to one another in a second locked position. Because of the adjustable ratchet mechanism, the shallow mouth collection ring and drain line assembly may be angled for use to direct flow of water from either a flat or tapered ceiling mounted sprinkler head or a wall mounted sprinkler head.

In a preferred embodiment of the invention, the handle has a hollow lower cavity including screw threads that cooperate with screw threads provided on an outer surface of an upper end portion of a pole. A first mounting strap or belt is connected to the handle for supporting the wound roll of flexible drain line of the invention so that the drain line is compactly mounted adjacent to the small mouth collection ring. Opposite ends of the first strap or belt include hook and loop engaging or fastening materials. A second strap or belt extends through an open core about which the drain hose is wound and also includes hook and loop engaging materials at the outer ends thereof that engage with the hook and loop engaging materials of the first strap to thereby secure the drain line to the handle. Other fasteners such as buckles and the like may also be used to secure the first and second straps or belts to one another.

The shallow mouth collection ring and drain line assembly further includes an air vent tube which opens into the small mouth collection ring and extends therefrom through the drain line and lip into a passageway formed in an upper portion of the handle. The passageway communicates with vent openings formed in the handle. The air vent tube also serves to lock the shallow mouth collection ring and drain line to the handle in such a manner that the air vent forms a pivot about which the shallow mouth collection ring and drain line assembly may pivot relative to the handle to thereby allow adjustment of an angle of the assembly relative to a pole and a ceiling or wall surface. A screw or pin extends into the handle, through openings in the air vent tube and into a threaded passage adjacent the vent tube within the handle. The screw thus locks the handle to each of the shallow mouth collection ring, upper portion of the drain line and the air vent tube. An inner opening of the air vent tube is oriented in a direction toward the flow of water through the shallow mouth collection ring. The air vent structure is provided to prevent any vapor lock from adversely affecting passage of water through the shallow mouth collection ring toward the drain line during use.

It should be noted that the handle can be constructed of plastic or other material. Also, an opening or slot is provided in a rear portion of the handle to facilitate mounting of the shallow mouth collection ring and drain line assembly from an appropriate hook or the like.

BRIEF DESCRIPTION OF THE DRAWINGS

A better understanding of the invention will be had with reference to the accompanying drawings wherein.

DESCRIPTION OF THE PREFERRED EMBODIMENTS

Figure 1:
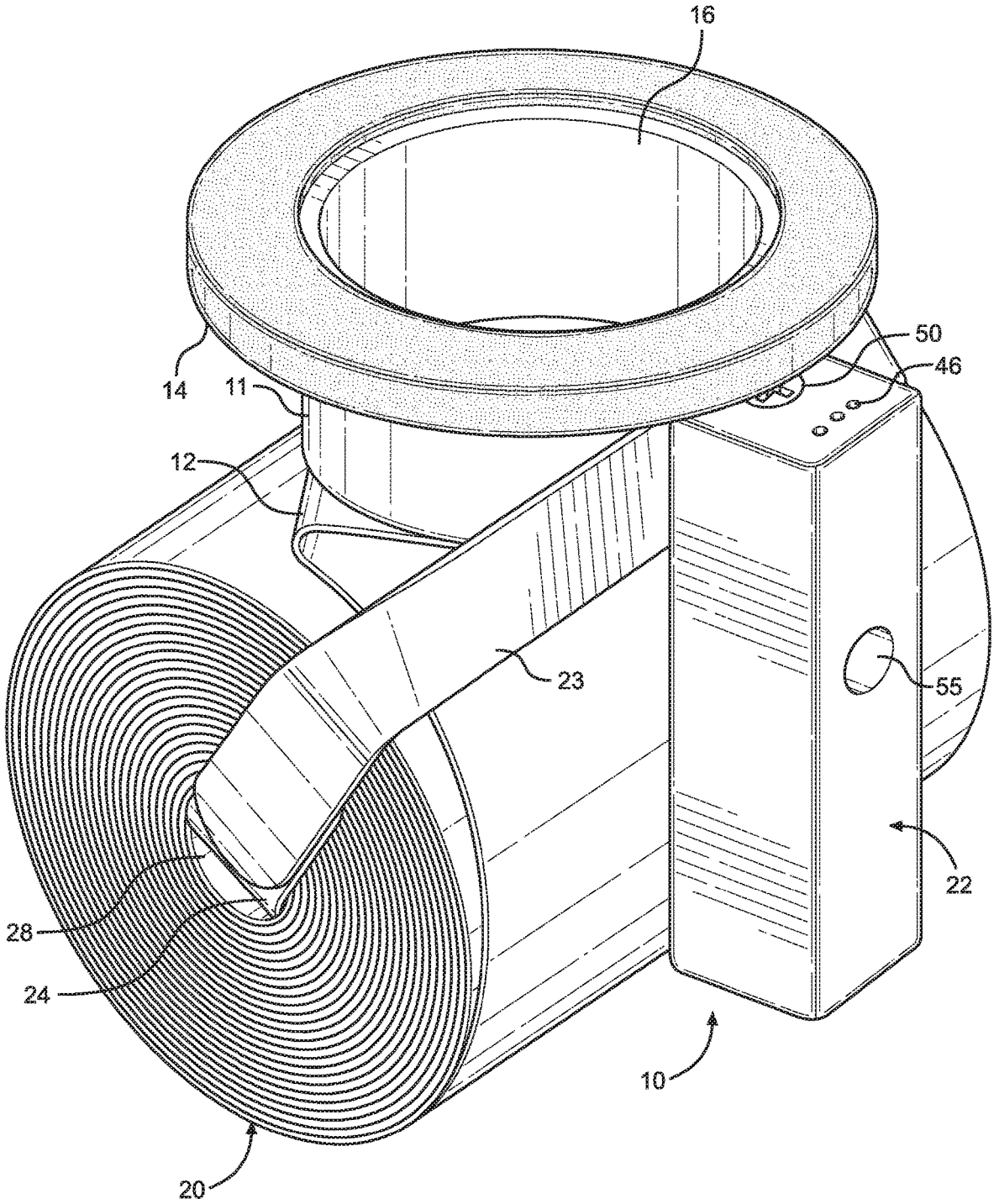
FIG. 1 is a perspective view of a fire sprinkler head emergency drain apparatus in accordance with the present invention.

With continued reference to the drawings, the fire sprinkler emergency drain apparatus of the present invention will be described in detail. The apparatus includes a shallow mouth collection ring and drain line assembly 10 having a tubular water conveying collection ring 11 to which is attached an extendable drain line or conduit 12. Although the collection ring is shown in the drawings as being circular, the collection ring may by of other configurations such as rectilinear, oval or oblong and the like as long as the collection ring is of a size to surround a sprinkler head to channel water being sprayed from the sprinkler head to the drain line. An annular lip 14 is secured to an upper end of the collection ring 11. The lip is outwardly flared and is preferably somewhat resilient or flexible for engaging a wall or ceiling surface about or around a fire sprinkler head 15, shown in dotted line in FIG. 2, to thereby direct all water or other liquid being discharged from the sprinkler head through the collection ring 11 and into the drain line 12. In this manner the water being discharged from the open sprinkler head will be conveyed to an appropriate drain or other area to thereby reduce damage to the surrounding structure and other items such as furniture, carpets and other flooring, electronics, art, pictures, cabinets, and communication devices such as televisions, computers, audio devices and the like. The invention is particularly designed to contain and drain water being discharged by a failed, broken or accidentally opened sprinkler head to a drain.

The shallow mouth collection ring and drain line assembly 10 are preferably formed of plastic materials that will melt quickly if exposed to fire. In this manner, should the emergency drain apparatus be deployed and a fire breaks out in the area of the opened sprinkler head, the assembly will quickly melt thereby allowing water being discharged from the sprinkler head to combat the fire.

Figure 2:
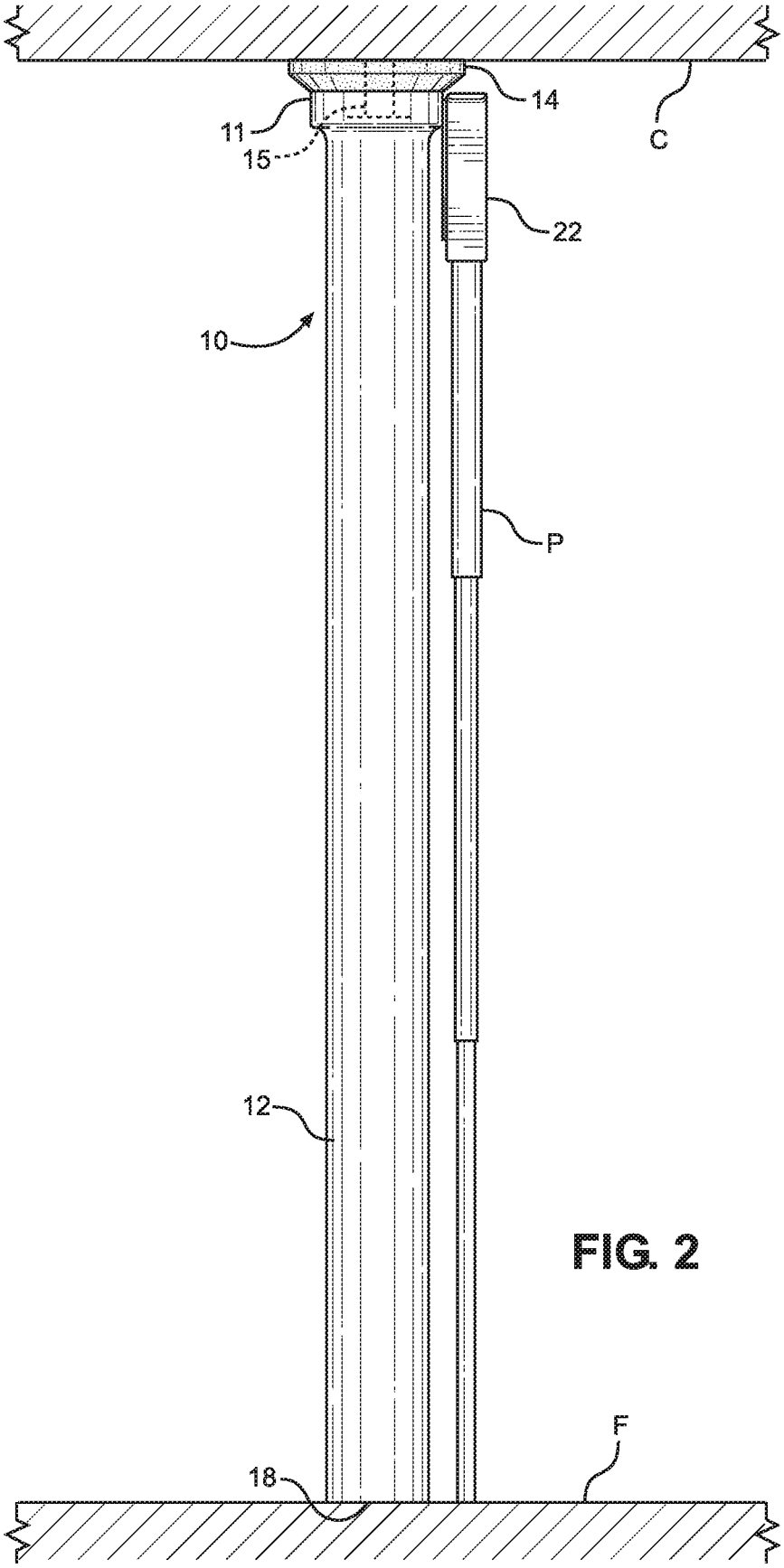
FIG. 2 is an illustrational view of the apparatus of FIG. 1 mounted to an adjustable pole which can be extended from a floor, or other support, to position a shallow mouth collection ring and drain line assembly over an opened fire sprinkler head mounted from a ceiling or wall with the drain line deployed to channel water to a drain.
Figure 3:
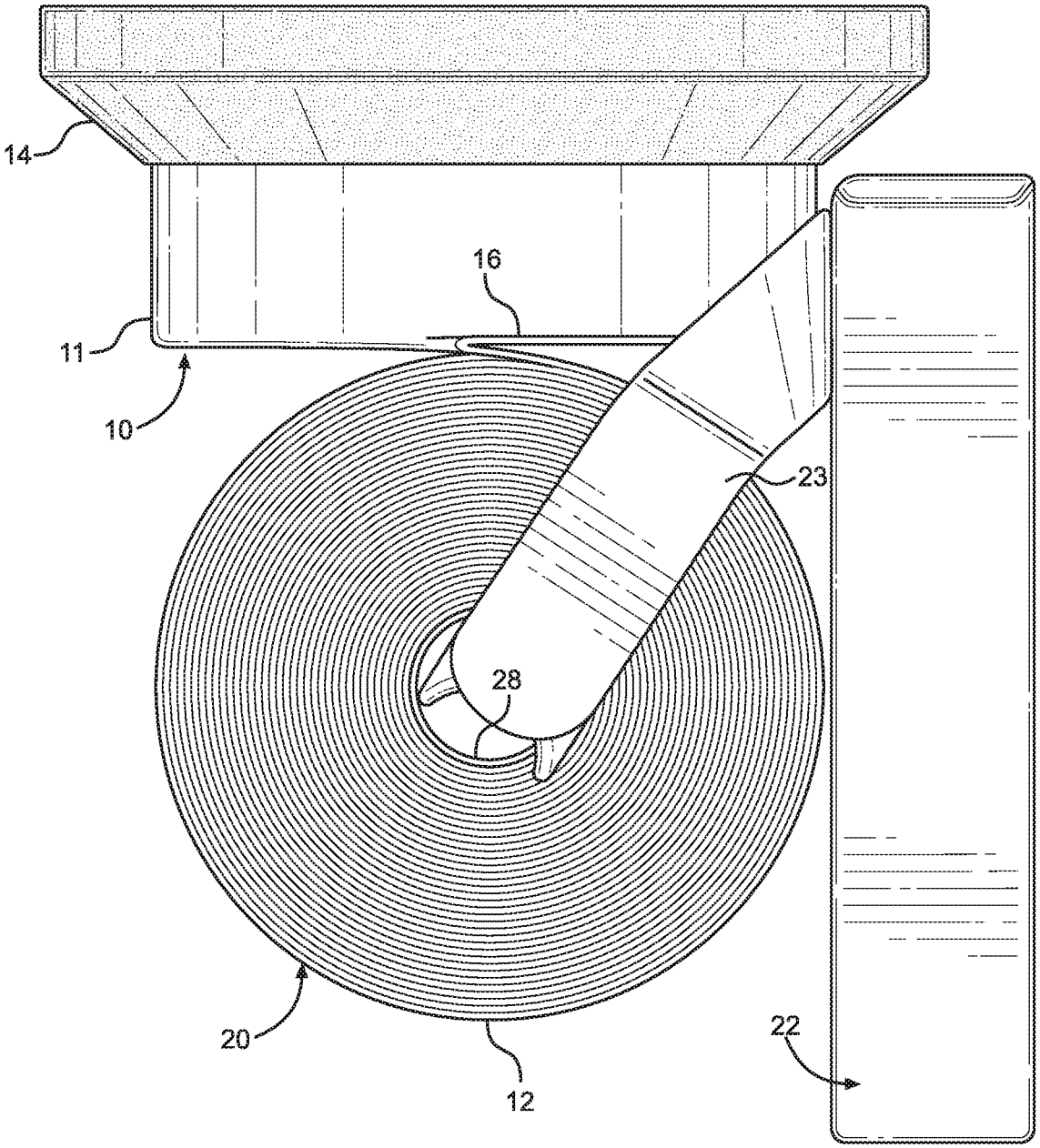
FIG. 3 is a side view of the fire sprinkler head emergency drain apparatus including the shallow mouth collection ring, drain line and handle shown in FIG. 1.

In the preferred embodiments of the invention, the drain line or conduit 12 is formed of a lightweight polypropylene or similar material that can withstand the pressure of water being discharged through an opened sprinkler head. By way of example, the hose is formed in a tubular structure in such a manner as to be wound, when in a generally flat configuration, into a roll 20 as shown in FIGS. 1 and 2. The drain line may be of a predetermined length, such as fifty or more feet, from an inner end 16, attached to the collection ring 11, to a discharge end 18. The diameter of the drain line may also vary, however, the diameter must be sufficient to allow all water being discharged from an opened sprinkler head to be safely conveyed to an appropriate drain or drainage area. As the drain line 12 can be wound in a flat configuration, the drain line can be compactly rolled for storage and be of lighter weight than prior art fire sprinkler emergency drain lines or hoses. A prototype of the invention has been constructed having a wound flattened hose which is approximately four inches in width and having a diameter when deployed of approximately three and one-half inches. As previously discussed, the shallow mouth collection ring and drain line assembly is light weight and easily storable. An assembly with a fifty foot drain hose in accordance with the teachings of the invention weighs less than approximately one pound and requires a storage space of no more than four by five inches.

Although the drain line 12 may be secured to the collection ring 11 in a variety of ways, as shown, the inner end 16 is mounted to surround the collection ring with an outer portion thereof folded to the inside of the ring, after which the drain lip 14 is frictionally insert onto the collection ring 11 to frictionally bind the drain line 12 between the lip and the collection ring. Although not shown in the drawings, in a modified embodiment of the invention, to further secure the drain line 12 to the collection ring 11, the lip may include an annular recess which would fit over the upper end of the collection ring and an extension or leg portion that would extend along an outer wall portion of the collection ring such that the inner end of the drain line will become seated and bound within the annular recess when the lip is mounted to the upper end of the collection ring and the leg portion of the lip would engage against the drain line along an outer wall of the collection ring.

The shallow mouth collection ring and drain line assembly 10 is mounted to a handle or bracket member 22 so as to form the fire sprinkler emergency drain apparatus of the invention. Belts or straps 23 and 24 are used to removable mount the shallow mouth collection ring and drain line assembly 10 to the handle 22 as shown in FIGS. 1 and 2. A first belt or strap 23 is secured to the handle as will be described here in after. The first strap has hook and loop fastening materials 25, such as Velcro®, at the opposite ends thereof, see FIG. 4. The second belt or strap 24 passes through a central tubular core 28 around which the drain line 12 is wound. The second strap has opposite ends including hook and loop fastening materials 29 that may be locked with the fastening materials 25 of the first strap to secure the shallow mouth collection ring and drain hose assembly 10 to the handle 22. Appropriate buckle devices may also be used to secure the ends of the straps together. The second belt or strap thus forms a support for the core 28 about which the wound drain line may rotate as the line is being deployed.

Figure 5:
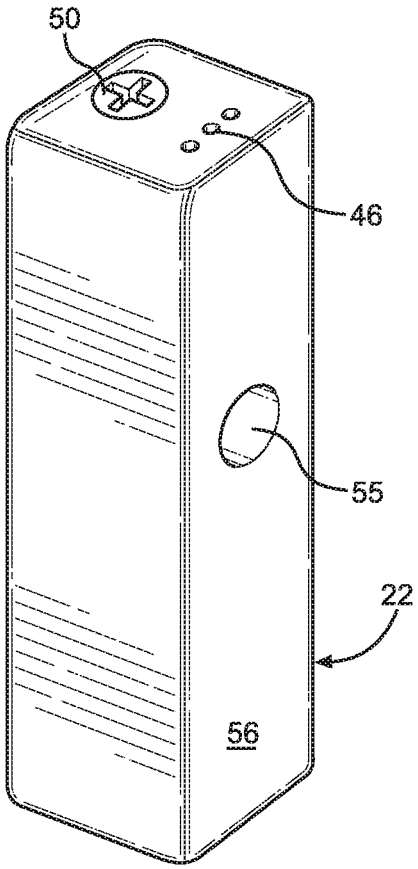
FIG. 5 is a front perspective view of the handle shown in FIG. 1.
Figure 6:
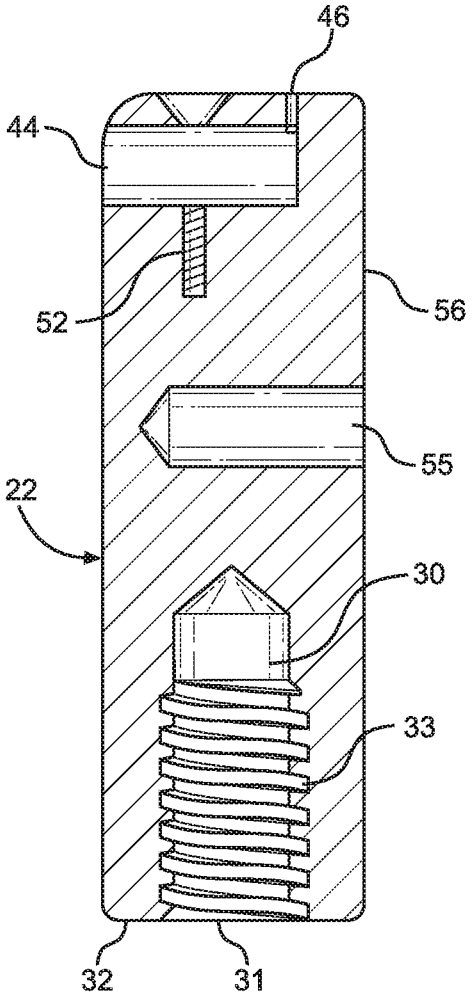
FIG. 6 is cross sectional view of the handle shown in FIG. 5.

With reference to FIGS. 5 and 6, the handle 22 is preferably made of plastic or similar material and has an elongated bore 30 which is open at 31 to a bottom portion 32 of the handle. The bore defines inner threads 33 for cooperatively mating with exterior threads of a conventional extension pole, see FIG. 2. In this manner the, the collection tube and drain hose assembly 10 may be quickly secured to any conventional extension pole or the assembly may be sold with an extensible and/or angularly adjustable pole.

Figure 4:
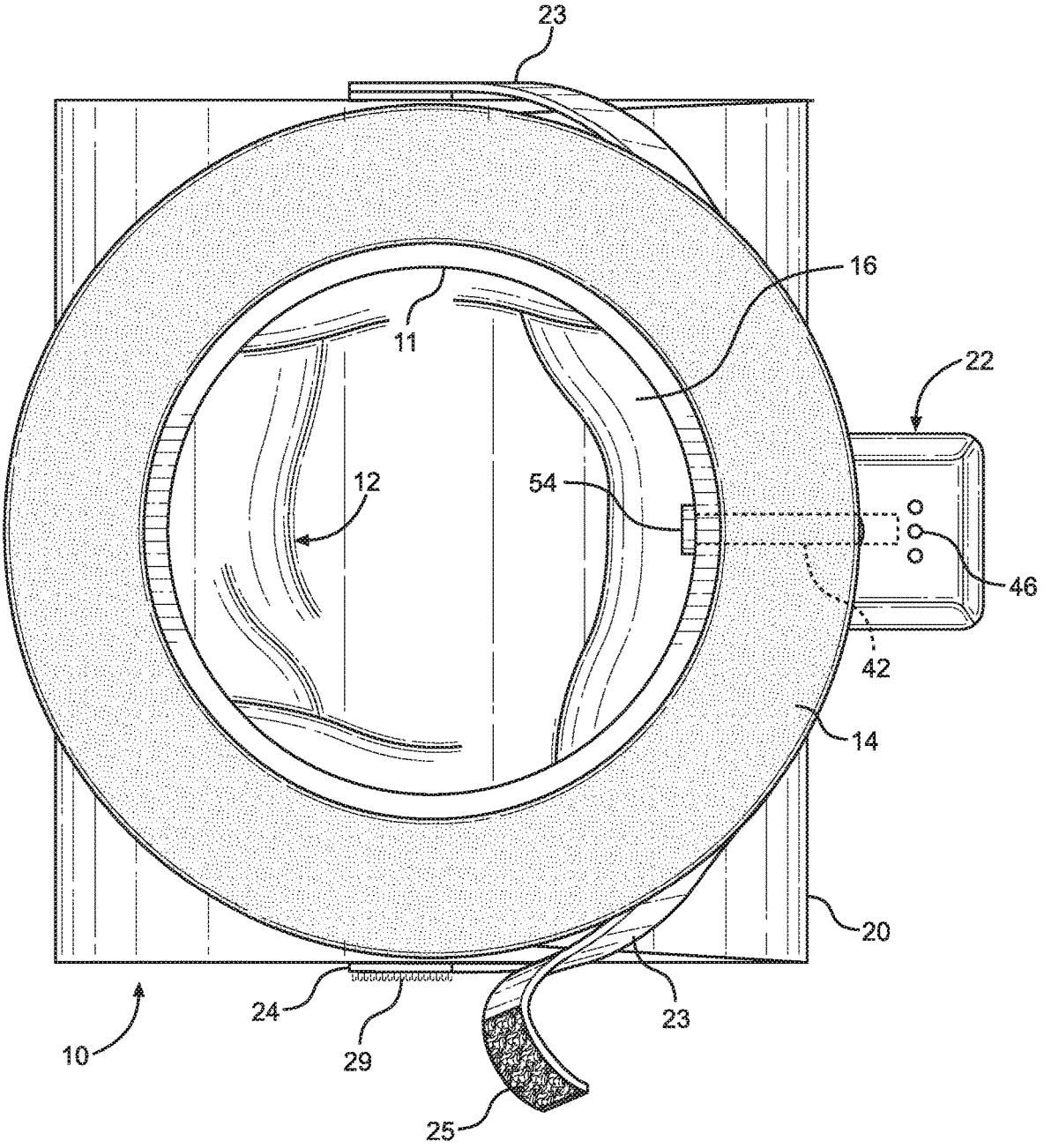
FIG. 4 is a top plan view of the fire sprinkler head emergency drain apparatus of FIG. 1.
Figure 7:
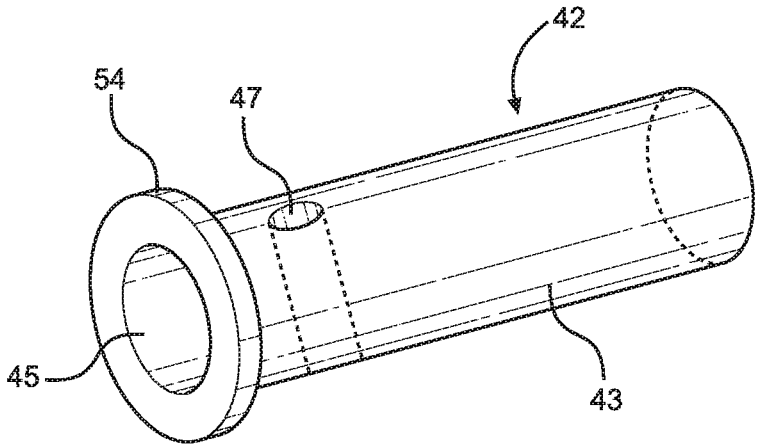
FIG. 7 is a perspective view of an air tube that is mounted within the handle of FIGS. 4 and 5.

Also mounted to the collection ring 11 and the upper portion of the drain line 12 is an air vent tube 42, see FIGS. 4 and 7, having a tubular body portion 43 that is mounted within a horizontal air passageway 44 formed in the handle 22 after passing through openings formed in a side wall of the collection ring 11 and the drain line 12. The air vent tube also includes an outlet surrounded by an annular rim 45 that communicates with the water passageway defined within the collection ring and drain line. The passageway 44 communicates with upwardly oriented air vents 46 that vent to the outside of the handle. The air vent tube, air passageway and openings in the collection tube and drain line are provided to prevent a vapor lock from forming within the collection ring and drain line as liquid is passing there through.

The annular rim 54 of the air vent tube 42 extends outwardly relative to the tubular body portion 43 such that the rim compresses against the upper or inner portion 16 of the drain line 12 and the inner wall of the collection ring 11 to secure the drain line relative to the collection ring. To further secure the shallow mouth collection ring and drain line assembly 10 to the handle 22, the air vent tube 42 has aligned openings 47 in the tubular body portion 43 that receive a mounting screw 50, see FIG. 5. The screw is received within a threaded bore 52, see FIG. 6, formed in the upper portion of the handle.

The air vent tube 42 also functions as a pivot about which the shallow mouth collection ring and drain line assembly 10 may rotate relative to the handle during use. In this manner, the orientation of the collection tube may easily vary to accommodate fire extinguisher spray heads mounted to a ceiling or a wall "C", regardless of the pitch or angle of the ceiling or wall, see FIG. 8 wherein the shallow mouth collection ring and drain line assembly 10 is shown vertically aligned with the handle 22 to surround a sprinkler head mounted to a horizontal ceiling "C" and shown in full line to surround a sprinkler head mounted to a sloped ceiling. The shallow mouth collection ring and drain line assembly 10 may be rotated to be perpendicular relative to the handle for vertical wall installed sprinkler heads. The air vent tube 42 also passes through the first strap 23, see FIG. 4, and thereby secures the first strap to the handle 22.

For hanging the emergency drain apparatus in storage when not in use, a hole 55 is provided in a rear wall 56 of the handle 22.

Figure 8:
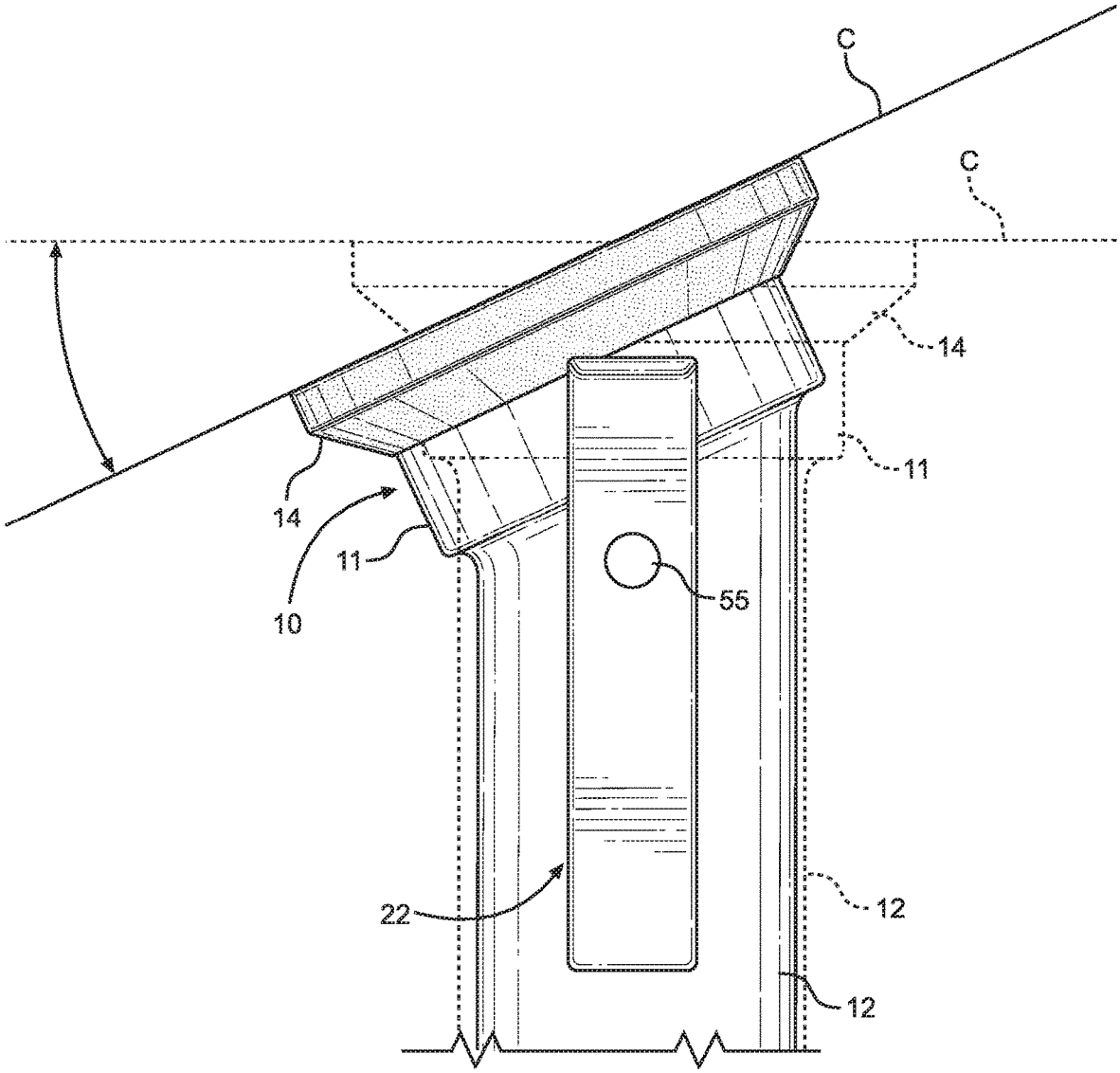
FIG. 8 is a perspective illustrational view of the fire sprinkler emergency drain apparatus of the present invention shown in solid line in a first position and in dotted line in an automatically self-adjusted position with an adjustable pole not being shown in the drawing figure.

In use of the fire sprinkler head emergency drain apparatus of the invention, the handle 22 is attached to a pole that may be an extendable pole "P". The extendable pole may be of conventional structure or may be one especially adapted to permit angular adjustment of the collection tube and drain hose assembly 10 relative to a ceiling "C" or wall mounted sprinkler head. In the preferred embodiment of the invention, the handle 22 has a hollow lower bore 30 including screw threads 33 that cooperate with screw threads provided on an outer surface of an upper end portion of the extendable pole. To deploy the drain hose, the first mounting strap or belt 23 which is connected to the handle for supporting the wound roll 20 of flexible drain line 12 of the invention so that the drain line is compactly positioned adjacent to the collection ring 11, is detached from the second strap 24 such as by separating the hook and loop engaging or fastening materials 25 and 29. The rolled drain line is thus free to deploy by rolling the reel of drain line about the core 28 through which the second strap or belt 24 extends. With reference to FIGS. 2 and 8, the pole "P" is thereafter manipulated to place the open end of the collection ring 11 over the opened sprinkler head 15 and the discharged end 18 of the drain line 12 is extended to an appropriate drain or drainage area. As the shallow mouth collection ring and drain line assembly 10 is pivotally mounted relative to the handle 22, the orientation of the collection ring may be easily changed to permit coverage of sprinkler heads mounted to ceilings that are horizontal or sloped and to vertical walls. Because of the light weight and compact size of the handle 22 and the shallow mouth collection tube and drain line assembly 10, the drain line may easily be deployed for use with the shallow mouth collection ring and drain line assembly be retained in place with the pole "P" extending between a floor "F" and ceiling or vertical wall "C" without further manual manipulation. After use, the drain line 12 may be re-wound about the core 28 and secured to the handle 22 by the first and second mounting straps.

I claim:

1. A fire sprinkler emergency drain apparatus for conveying liquid from an open or leaking sprinkler head or leaking portion of a fire extinguishing system to a drain comprising, a shallow mouth collection ring and drain line assembly including a collection ring having an upper rim of a size to surround a fire sprinkler head or a recessed opening in which a fire sprinkler head is positioned and a flexible drain line connected at one end to the collection ring to convey liquid passing through the collection ring to the drain, the drain line being wound in a roll configuration wherein the drain line is flattened in cross sectional configuration with an inner end of a hose mounted to the collection ring, the shallow mouth collection ring and drain line assembly being supported by a handle, the handle being adapted to be attached to a pole for use in elevating the small mouth collection ring and drain line assembly relative to an open or leaking sprinkler head, releasing means for releasing the wound roll of drain line so that a discharge end of the drain line may be deployed to the drain to discharge liquid passing through the drain line, and an air vent passageway through the handle and having a first exterior opening communicating with an area inside the collection ring to thereby prevent a vapor lock when liquid is passing through the collection ring and at least one second exterior opening spaced from the first exterior opening, wherein the shallow mouth collection ring and drain line assembly is formed from materials that will melt when exposed to fire.

2. The fire sprinkler emergency drain apparatus of claim 1 wherein the roll configuration of the flattened drain line is wound about an open central core member.

3. The fire sprinkler emergency drain apparatus of claim 2 wherein the drain line is constructed of a polypropylene material.

4. The fire sprinkler emergency drain apparatus of claim 3 wherein the shallow mouth collection ring and drain line assembly is formed from materials that will melt when exposed to fire.

5. The fire sprinkler emergency drain apparatus of claim 4 in combination with a pole adapted to be connected to the handle.

6. The fire sprinkler emergency drain apparatus of claim 1 in combination with a pole adapted to be connected to the handle.

7. The fire sprinkler emergency drain apparatus of claim 1 wherein the drain line is constructed of a polypropylene material.

8. A fire sprinkler emergency drain apparatus for conveying liquid from an open or leaking sprinkler head or leaking portion of a fire extinguishing system to a drain comprising, a shallow mouth collection ring and drain line assembly including a collection ring having an upper rim of a size to surround a fire sprinkler head or a recessed opening in which a fire sprinkler head is positioned and a flexible drain line connected at one end to the collection ring to convey liquid passing through the collection ring to the drain, the drain line being wound in a roll configuration wherein the drain line is flattened in cross sectional configuration with an inner end of a hose mounted to the collection ring, the shallow mouth collection ring and drain line assembly being supported by a handle, the handle being adapted to be attached to a pole for use in elevating the small mouth collection ring and drain line assembly relative to an open or leaking sprinkler head, releasing means for releasing the wound roll of drain line so that a discharge end of the drain line may be deployed to the drain to discharge liquid passing through the drain line, and an air vent passageway through the handle and having a first exterior opening communicating with an area inside the collection ring to thereby prevent a vapor lock when liquid is passing through the collection ring and at least one second exterior opening spaced from the first exterior opening.

9. The fire sprinkler emergency drain apparatus of claim 8 including an air vent tube having a tubular body portion mounted within the air vent passageway extending from the air vent passageway through an opening in the drain line and through an opening in the collection ring, and the air vent tube having an outer opening which communicates with liquids passing through the collection ring.

10. The fire sprinkler emergency drain apparatus of claim 9 wherein the air vent tube serves as a pivot for pivotal movement of the shallow mouth collection ring and drain line assembly relative to the handle.

11. The fire sprinkler emergency drain apparatus of claim 10 including aligned openings through the tubular body portion of the air vent tube and fastening means extending into the handle and through the aligned opens to secure the shallow mouth collection ring and drain line assembly to the handle.

12. The fire sprinkler emergency drain apparatus of claim 11 wherein the roll configuration of the flattened drain line is wound about an open central core member.

13. The fire sprinkler emergency drain apparatus of claim 12 wherein the releasing means includes a first strap member secured to the handle and having oppositely extending end portions, and a second strap member extending through the open central core member and having oppositely extending end portions and releasable connecting means for securing the opposite end portions of the first strap member to the opposite end portions of the second strap member.

14. The fire sprinkler emergency drain apparatus of claim 13 wherein the releasable connecting means includes first and second hook and loop fastening members.

15. The fire sprinkler emergency drain apparatus of claim 8 in combination with a pole adapted to be connected to the handle.

16. The fire sprinkler emergency drain apparatus of claim 8 wherein the drain line is constructed of a polypropylene material.

* * * * *